US011603751B2

(12) United States Patent
Zhang et al.

(10) Patent No.: US 11,603,751 B2
(45) Date of Patent: Mar. 14, 2023

(54) PUSH-PULL FORCE CONTROL METHOD FOR HORIZONTAL DIRECTIONAL DRILLING MACHINE AND HORIZONTAL DIRECTIONAL DRILLING MACHINE

(71) Applicant: XUZHOU XUGONG FOUNDATION CONSTRUCTION MACHINERY CO., LTD., Xuzhou (CN)

(72) Inventors: Li Zhang, Xuzhou (CN); Zhonghai Zhang, Xuzhou (CN); Jiguang Zhang, Xuzhou (CN); Weixiang Lv, Xuzhou (CN); Yonghua Zhang, Xuzhou (CN); Peng Wang, Xuzhou (CN); Jinlong Lu, Xuzhou (CN); Ming Li, Xuzhou (CN); Changjian Qin, Xuzhou (CN)

(73) Assignee: XUZHOU XUGONG FOUNDATION CONSTRUCTION MACHINERY CO., LTD., Xuzhou (CN)

( * ) Notice: Subject to any disclaimer, the term of this patent is extended or adjusted under 35 U.S.C. 154(b) by 0 days.

(21) Appl. No.: 17/280,196

(22) PCT Filed: Jul. 25, 2019

(86) PCT No.: PCT/CN2019/097796
§ 371 (c)(1),
(2) Date: Mar. 26, 2021

(87) PCT Pub. No.: WO2020/073718
PCT Pub. Date: Apr. 16, 2020

(65) Prior Publication Data

US 2022/0003109 A1 Jan. 6, 2022

(30) Foreign Application Priority Data

Oct. 10, 2018 (CN) ..... 201811176535.9

(51) Int. Cl.
*E21B 7/04* (2006.01)
*E21B 44/02* (2006.01)

(52) U.S. Cl.
CPC ..... *E21B 44/02* (2013.01); *E21B 7/046* (2013.01)

(58) Field of Classification Search
CPC ..... E21B 44/02; E21B 7/046
See application file for complete search history.

(56) References Cited

U.S. PATENT DOCUMENTS 4,109,733 A 8/1978 Dummer
4,236,408 A 12/1980 Corry
(Continued)

FOREIGN PATENT DOCUMENTS

CN 204140525 U 2/2015
CN 204627580 U * 9/2015
(Continued)

*Primary Examiner* — Taras P Bemko
(74) *Attorney, Agent, or Firm* — Bayramoglu Law Offices LLC

(57) ABSTRACT

A push-pull force control method for a horizontal directional drilling machine with the following steps is provided. According to a correspondence relationship between a motor displacement and a maximum push-pull force of a drilling machine, the motor displacement is first adjusted, so that the required push-pull force can be obtained through the adjustment of the subsequent steps. Then, an oil feeding pressure of the motor is controlled according to a relationship between the push-pull force and the working pressure difference of the motor. Finally, the push-pull force of the motor is controlled in real time according to the oil feeding pressure of the motor to be equal to the required push-pull force value.

15 Claims, 4 Drawing Sheets

(56) References Cited

U.S. PATENT DOCUMENTS

| | | | | |
|---|---|---|---|---|
| 2003/0205409 | A1* | 11/2003 | Koch | C12N 9/93 175/26 |
| 2014/0033696 | A1* | 2/2014 | Thoms | F04B 49/22 60/413 |

FOREIGN PATENT DOCUMENTS

| | | | |
|---|---|---|---|
| CN | 204627580 | U | 9/2015 |
| CN | 106168113 | A | 11/2016 |
| CN | 109184561 | A | 1/2019 |
| CN | 208885183 | U | 5/2019 |

* cited by examiner

PUSH-PULL FORCE CONTROL METHOD FOR HORIZONTAL DIRECTIONAL DRILLING MACHINE AND HORIZONTAL DIRECTIONAL DRILLING MACHINE

CROSS REFERENCE TO THE RELATED APPLICATIONS

This application is the national phase entry of International Application No. PCT/CN2019/097796, filed on Jul. 25, 2019, which is based upon and claims priority to Chinese Patent Application No. 201811176535.9, filed on Oct. 10, 2018, the entire contents of which are incorporated herein by reference.

TECHNICAL FIELD

The present invention relates to the field of construction machinery, and more particularly, to a push-pull force control method for a horizontal directional drilling machine and a horizontal directional drilling machine.

BACKGROUND

During the construction process using a horizontal directional drilling machine, a motor is driven by a hydraulic pump to rotate, and a drill pipe and a drilling tool are driven by a reducer, a gear wheel and a gear rack. In order to ensure safety of the construction, during the actual construction process, it is necessary to adjust a maximum push-pull force output by the horizontal directional drilling machine according to different geological conditions and cutting drilling tools to avoid damage to the drill pipe and the drilling tool.

The prior art has at least the following problems. In order to avoid damage to the drill pipe and the drilling tool, the approach of adjusting a maximum working pressure of a hydraulic motor is adopted to limit the maximum push-pull force output by the horizontal directional drilling machine. This approach can only adjust the maximum working pressure of the hydraulic motor. When the working displacement of the hydraulic motor changes, it is necessary to re-adjust the maximum working pressure of the hydraulic motor. During actual operation, however, it is often forgotten to re-adjust the maximum working pressure, thereby causing the damage to the drill pipe and the drilling tool.

SUMMARY

The present invention provides a push-pull force control method for a horizontal directional drilling machine and a horizontal directional drilling machine to optimize the push-pull force control method of the horizontal directional drilling machine to be more reasonable.

A push-pull force control method for a horizontal directional drilling machine, including the following steps:

S100: adjusting a working displacement of a motor to enable a maximum push-pull force $F_{max}$ corresponding to the working displacement to be greater than a set push-pull force $F_t$;

S200: calculating a working pressure difference ΔP of the motor according to the set push-pull force $F_t$;

S300: calculating a working pressure required by the motor according to the working pressure difference ΔP and a collected first oil return back pressure of the motor; and

S400: adjusting an oil feeding pressure of the motor to enable the oil feeding pressure of the motor to be equal to the working pressure required by the motor.

In some embodiments, the step S100 includes:

collecting a voltage signal corresponding to a current gear position of a motor working gear knob;

controlling a control voltage or a control current of a displacement control valve of the motor according to the voltage signal to control the working displacement of the motor;

calculating the working displacement $q_m$ of the motor;

calculating the maximum push-pull force $F_{max}$ corresponding to the working displacement $q_m$ of the motor; and comparing the maximum push-pull force $F_{max}$ with the set push-pull force $F_t$, and if $F_t \geq F_{max}$, changing the control voltage or the control current of the displacement control valve of the motor to change the working displacement of the motor until $F_t < F_{max}$.

In some embodiments, the maximum push-pull force $F_{max}$ corresponding to the displacement $q_m$ of the motor is calculated by the following formula:

$$F_{max} = \frac{\Delta P_{max} \cdot q_m \cdot i}{2\pi \cdot R},$$

where $F_{max}$ is the maximum push-pull force output by a current gear position of the drilling machine; $\Delta P_{max}$ is a maximum working pressure difference of the motor allowed by a hydraulic system; $q_m$ is the displacement of a current working gear position of the motor; i is a velocity ratio of a reducer connected to the motor; and R is a reference radius of a gear wheel connected to the reducer.

In some embodiments, in the step S200, the working pressure difference ΔP is calculated by the following formula:

$$\Delta P = \frac{2\pi \cdot R \cdot F_t}{q_m \cdot i},$$

where $q_m$ is the displacement of a current working gear position of the motor; i is a velocity ratio of a reducer connected to the motor; and R is a reference radius of a gear wheel connected to the reducer.

In some embodiments, in the step S300, a pressure of an oil return port of the motor is collected as the first oil return back pressure.

In some embodiments, in the step S300, the first oil return back pressure of the motor is collected by the following steps:

collecting working pressures of two working oil ports of the motor; and comparing the collected working pressures of the two working oil ports of the motor, and using a relatively small working pressure as the first oil return back pressure.

In some embodiments, the working pressures of the two working oil ports of the motor are collected using following steps:

using a first pressure sensor to detect a working pressure of one of the working oil ports of the motor; and using a second pressure sensor to detect a working pressure of the other one of the working oil ports of the motor.

In some embodiments, the push-pull force control method for the horizontal directional drilling machine further includes the following steps:

S500: monitoring a collected second oil return back pressure of the motor in real time, and performing a comparison to determine whether the collected second oil return back pressure is equal to the first oil return back pressure; and

S600: if the second oil return back pressure is not equal to the first oil return back pressure, adjusting the oil feeding pressure of the motor to enable the oil feeding pressure of the motor to be equal to the working pressure required by the motor and enable the oil return back pressure of the motor to be equal to the first oil return back pressure.

In some embodiments, the step S400 includes:

calculating a control current required by the pressure control valve of the motor according to the working pressure required by the motor; and adjusting a control current of the pressure control valve to be equal to the control current required by the pressure control valve.

Another embodiment of the present invention provides a horizontal directional drilling machine, including:

a motor;

a motor displacement adjusting assembly, which is connected to the motor, and is configured to adjust a displacement of the motor;

an oil return back pressure detecting assembly, which is connected to the motor, and is configured to detect an oil return back pressure of the motor;

a pressure control valve, which is connected to the motor, and is configured to control a working pressure of the motor;

a motor push-pull force setting assembly, which is configured to set a push-pull force of the motor; and a controller, which is connected to the motor displacement adjusting assembly, the oil return back pressure detecting assembly, the pressure control valve and the motor push-pull force setting assembly.

In some embodiments, the motor includes a variable motor.

In some embodiments, the motor displacement adjusting assembly includes:

a motor working gear knob, which is connected to the controller; and a displacement control valve, which is connected to the controller and the motor. The controller is configured to control a current or a voltage of the displacement control valve according to a gear position where the motor working gear knob is located to control the displacement of the motor.

In some embodiments, the oil return back pressure detecting assembly includes:

a first pressure sensor, which is configured to detect a pressure of one of an oil inlet and an oil outlet of the motor; and a second pressure sensor, which is configured to detect a pressure of the other one of the oil inlet and the oil outlet of the motor.

In some embodiments, the motor push-pull force setting assembly includes:

a push-pull force adjusting component, which is connected to the controller; and a display component, which is arranged at a periphery of the push-pull force adjusting component, and is configured to display a gear position where the push-pull force adjusting component is located.

In some embodiments, the motor push-pull force setting assembly includes a potentiometer.

In the above technical solution, according to a correspondence relationship between a motor displacement and a maximum push-pull force of a drilling machine, the motor displacement is first adjusted, so that the required push-pull force can be obtained through the adjustment of the subsequent steps. Then, an oil feeding pressure of the motor is controlled according to a relationship between the push-pull force and the working pressure difference of the motor. Finally, the push-pull force of the motor is controlled in real time according to the oil feeding pressure of the motor to be equal to the required push-pull force value. The above technical solution implements accurate and fast control of the push-pull force of the horizontal directional drilling machine.

BRIEF DESCRIPTION OF THE DRAWINGS

The drawings described here are used to provide further understanding of the present invention and constitute a part of the present invention. Exemplary embodiments and description thereof of the present invention are used to illustrate the present invention, but do not constitute improper limitations to the present invention. In the drawings.

DETAILED DESCRIPTION OF THE EMBODIMENTS

The technical solutions provided by the present invention are illustrated below in detail with reference to FIGS. 1-4.

Figure 1:
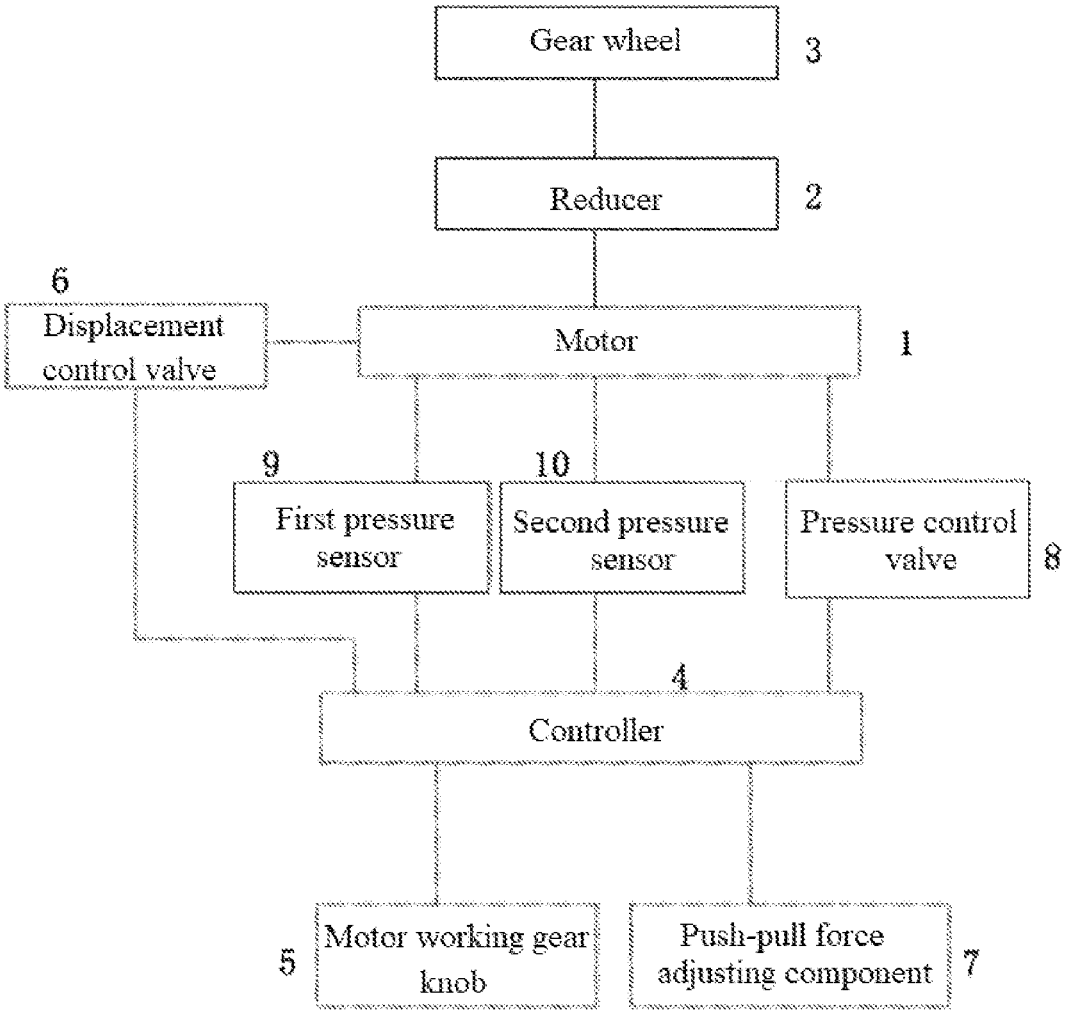
FIG. 1 is a schematic diagram of the principle of a horizontal directional drilling machine according to an embodiment of the present invention.
Figure 2:
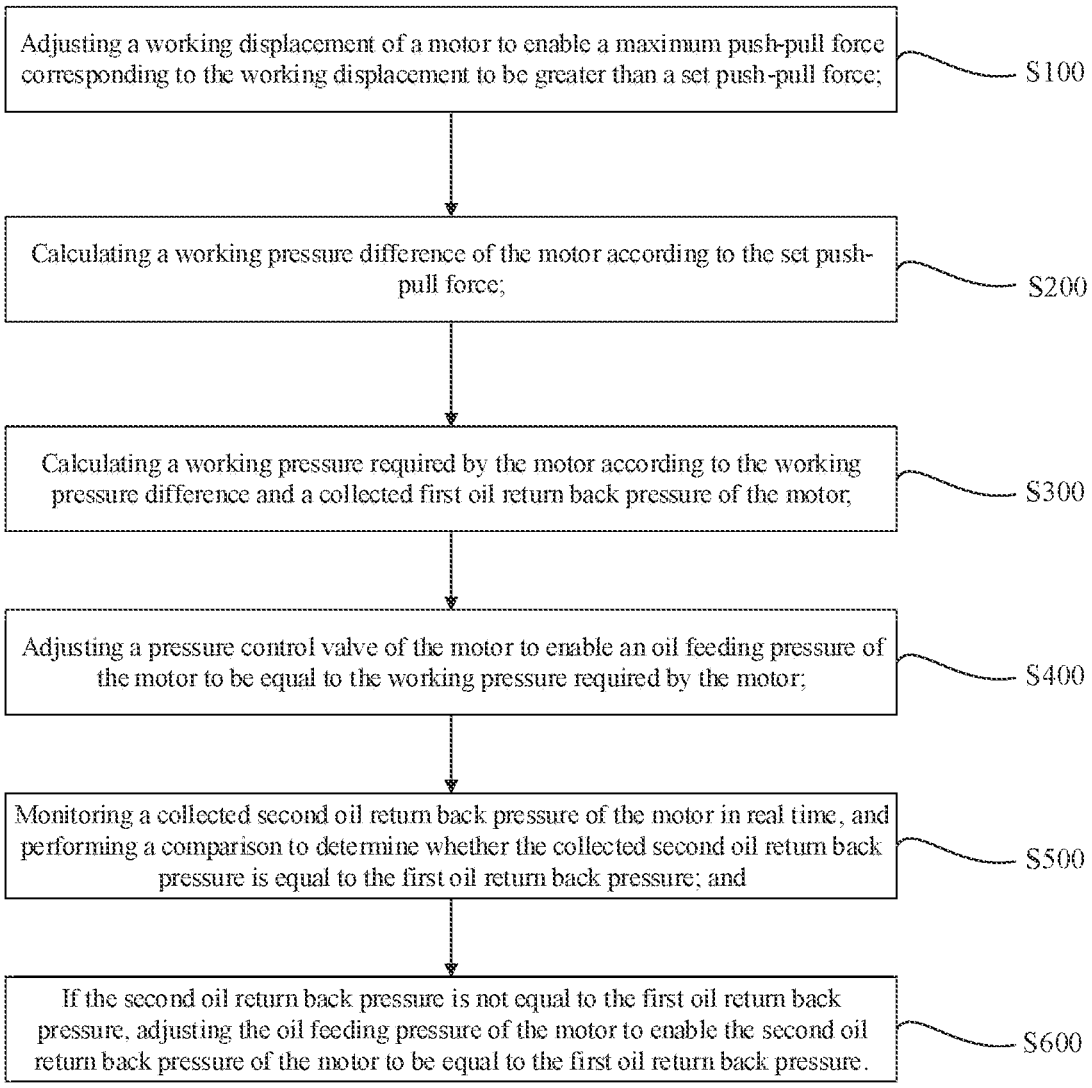
FIG. 2 is a schematic diagram of the principle of a push-pull force control method for the horizontal directional drilling machine according to an embodiment of the present invention.
Figure 3:
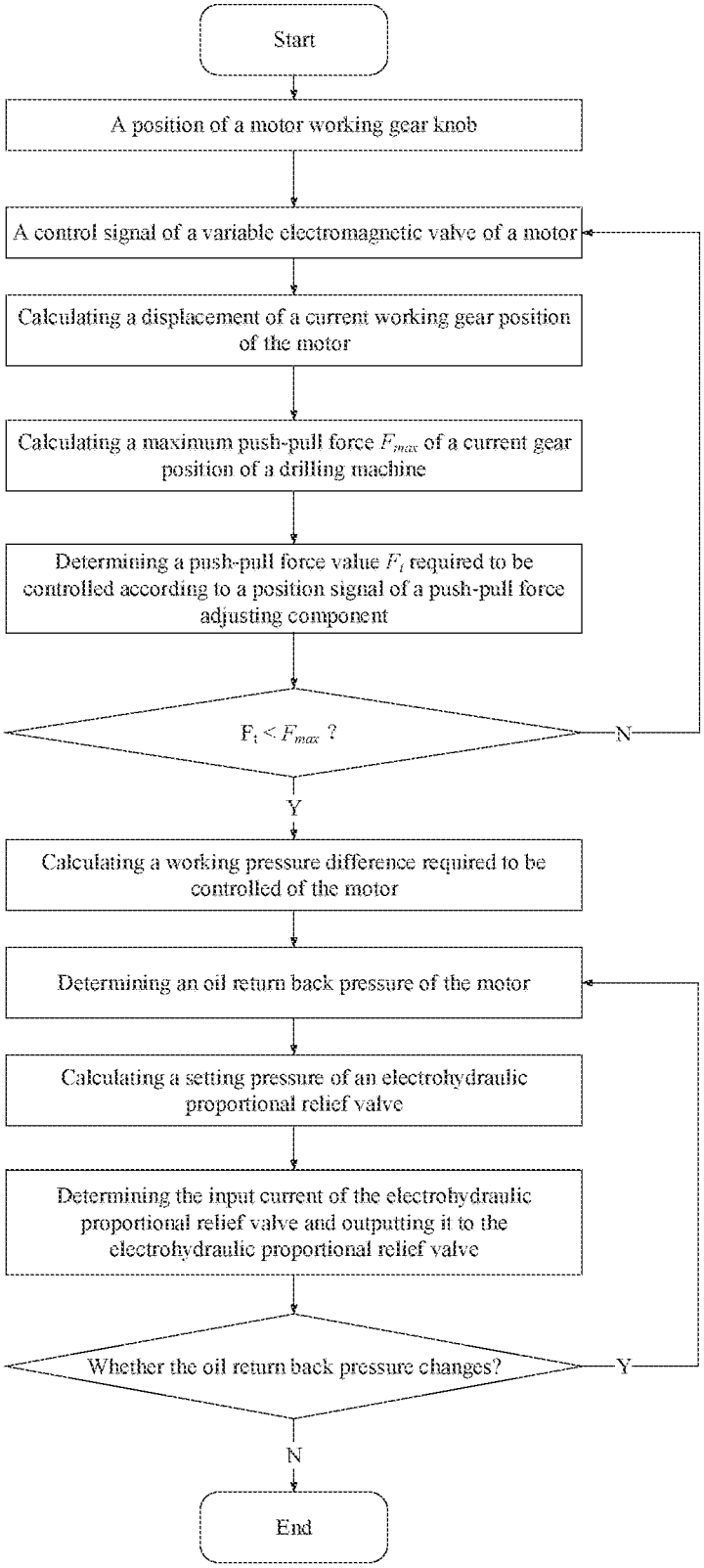
FIG. 3 is a flow chart of the push-pull force control method for the horizontal directional drilling machine according to an embodiment of the present invention.

A drilling machine being a horizontal directional drilling machine is taken as an example. As shown in FIG. 1, the horizontal directional drilling machine includes the motor 1, the reducer 2, the gear wheel 3, the controller 4, and the motor working gear knob 5. A hydraulic pump drives the motor 1 to rotate, and the motor 1 drives a drill pipe and a drilling tool to work by the reducer 2, the gear wheel 3 and a gear rack.

The controller 4 is connected to the motor working gear knob 5. The displacement control valve 6 is integrated on the motor 1. The displacement of the motor 1 is controlled by controlling the displacement control valve 6. The motor working gear knob 5 is provided with a plurality of knob positions, and when the knob is located at different positions, voltages corresponding to the different positions are different. The motor working gear knob 5 is electrically connected to the controller 4. The controller 4 receives a voltage signal of the motor working gear knob 5, and converts it to a current signal or a voltage signal. The current signal or the voltage signal is provided as a control signal to the displacement control valve 6 integrated on the motor 1, and a working displacement of the motor 1 is changed by the displacement control valve 6.

The push-pull force adjusting component 7 is arranged on the motor 1. The push-pull force adjusting component may be steplessly adjusted, and its different positions correspond to different push-pull force values. The push-pull force adjusting component 7 is electrically connected to the controller 4. The controller 4 determines a push-pull force value required to be controlled according to a received position signal of the push-pull force adjusting component 7.

In order to collect oil pressures of two working oil ports of the motor 1, in some embodiments, the drilling machine further includes the controller 4, the first pressure sensor 9 and the second pressure sensor 10. One of the two working oil ports of the motor 1 is used as an oil inlet, while the other one is used as an oil outlet. When a rotation direction of the motor 1 is different, the oil inlet and the oil outlet are exchanged.

In order to control an oil feeding pressure of the motor 1, the drilling machine further includes the pressure control valve 8. The pressure control valve 8 is configured to adjust a maximum working pressure of the motor 1. The oil feeding pressure of the motor 1 is controlled by controlling the current of the pressure control valve 8. The pressure control valve 8 is specifically, for example, an electrohydraulic proportional relief valve.

The first pressure sensor 9 and the second pressure sensor 10 are configured to detect pressures of the two working oil ports of the motor 1, and transfer detected pressure signals to the controller 4.

An embodiment of the present invention provides a push-pull force control method for a horizontal directional drilling machine, including following steps.

S100: a working displacement of the motor 1 is adjusted to enable a maximum push-pull force $F_{max}$ corresponding to the working displacement to be greater than a set push-pull force $F_t$.

The motor 1 is specifically a variable motor. The displacement control valve 6 is integrated on the motor 1, and a displacement of the motor 1 is controlled by the displacement control valve 6. The displacement control valve 6 is specifically, for example, an electromagnetic valve, and the displacement of the motor 1 is controlled by controlling the voltage or current of the electromagnetic valve.

There exists a definite functional relationship between the working displacement of the motor 1 and the maximum push-pull force $F_{max}$ of the drilling machine, so that once the working displacement of the motor 1 is known, the maximum push-pull force $F_{max}$ of the drilling machine is obtained through calculation.

S200: a working pressure difference ΔP of the motor 1 is calculated according to the set push-pull force $F_t$.

The push-pull force $F_t$ is a set value, which is related to a type and a model of the drilling tool, and an operator determines the push-pull force $F_t$ according to the type and the model of the drilling tool. The push-pull force $F_t$, after being set, will not change as the displacement of the motor 1 changes. In subsequent operation steps, the displacement and the oil feeding pressure of the motor 1 are adjusted by taking the push-pull force $F_t$ as a reference to enable the push-pull force $F_t$ to be basically a constant value.

In some embodiments, the working pressure difference ΔP of the motor 1 is calculated by the following formula (1):

$$\Delta P = \frac{2\pi \cdot R \cdot F_t}{q_m \cdot i} \tag{1}$$

In the above formula (1), $q_m$ is a working displacement of a current working gear position of the motor 1; i is a velocity ratio of the reducer 2 connected to the motor 1; and R is a reference radius of the gear wheel 3 connected to the reducer 2.

As can be seen from the above formula (1), in the case that $F_t$, i and R all are constant values, there exists a definite functional relationship between $q_m$ and ΔP. In an actual working process, $q_m$ is a variable and changes in real time. In this case, ΔP can be adjusted to enable $F_t$ to basically retain a constant value.

S300: the working pressure $P_2$ required by the motor 1 is calculated according to the working pressure difference ΔP of the motor 1 and the collected first oil return back pressure $P_1$ of the motor 1.

$$\Delta P = P_2 - P_1 \tag{2}$$

In the above formula (2), the first oil return back pressure $P_1$ can be detected by using a sensor, while the working pressure difference ΔP of the motor 1 is obtained according to the above formula (1). Therefore, the working pressure $P_2$ of the motor 1 can be obtained according to the above formula (2).

S400: the pressure control valve 8 of the motor 1 is adjusted to enable the oil feeding pressure of the motor 1 to be equal to the working pressure required by the motor 1.

In some embodiments, the step S100 specifically includes the following steps.

At first, a voltage signal corresponding to a current gear position of a motor working gear knob is collected. Specifically, the voltage signal of the current working gear position of the motor working gear knob 5 is collected according to a position where the motor working gear knob 5 is located.

Then, the control voltage or control current of the displacement control valve 6 of the motor 1 is controlled according to the voltage signal to control the working displacement of the motor 1.

Subsequently, the working displacement $q_m$ of the motor 1 is calculated. A correspondence relationship between the current working gear position and the displacement $q_m$ of the motor 1 is determined, for example, it can be obtained by inquiry according to product manuals.

Next, the maximum push-pull force $F_{max}$ corresponding to the working displacement $q_m$ of the motor 1 is calculated.

Next, the maximum push-pull force $F_{max}$ is compared with the currently set push-pull force $F_t$. If $F_t \geq F_{max}$, the control voltage or control current of the displacement control valve 6 of the motor 1 is changed to change the working displacement of the motor 1 until $F_t < F_{max}$.

In some embodiments, the maximum push-pull force $F_{max}$ corresponding to the working displacement $q_m$ of the motor 1 is calculated by the following formula (3):

$$F_{max} = \frac{\Delta P_{max} \cdot q_m \cdot i}{2\pi \cdot R} \tag{3}$$

In the formula (3), $F_{max}$ is the maximum push-pull force output by a current gear position of the drilling machine; $\Delta P_{max}$ is a maximum working pressure difference of the motor 1 allowed by a hydraulic system; $q_m$ is a displacement of a current working gear position of the motor 1; i is a velocity ratio of the reducer 2 connected to the motor 1; and R is a reference radius of the gear wheel 3 connected to the reducer 2.

In some embodiments, in the above step S200, the working pressure difference ΔP is calculated according to the following formula.

In some embodiments, in the above step S300, a pressure of an oil return port of the motor 1 is collected as the first oil return back pressure. For example, a sensor is adopted to first identify which one of the two working oil ports of the motor 1 is the oil return port, and then detect the pressure of the oil return port.

Alternatively, in some embodiments, in the above step S300, the first oil return back pressure of the motor 1 is collected by the following steps.

Firstly, the working pressures of the two working oil ports of the motor 1 are collected. Specifically, for example, two pressure sensors are adopted to collect the working pressures of the two working oil ports of the motor 1. The first pressure sensor 9 is used to detect a working pressure of one of the working oil ports of the motor 1, and the second pressure sensor 10 is used to detect a working pressure of the other one of the working oil ports of the motor 1.

Secondly, the collected working pressures of the two working oil ports of the motor 1 are compared, and the relatively small working pressure is used as the first oil return back pressure.

The above manner is adopted to obtain the first oil return back pressure without identifying which one of the two working oil ports of the motor 1 is the oil return port, and it is only necessary to use the detected relatively small working pressure of the two working oil ports as the first oil return back pressure.

In some embodiments, the push-pull force control method for the horizontal directional drilling machine further includes the following steps:

S500: a collected second oil return back pressure of the motor 1 is monitored in real time, and a comparison is performed to determine whether the collected second oil return back pressure is equal to the first oil return back pressure.

S600: if the second oil return back pressure is not equal to the first oil return back pressure, the oil feeding pressure of the motor 1 is adjusted to enable the second oil return back pressure of the motor 1 to be equal to the first oil return back pressure.

Hereinafter, adjustment of the working pressure of the motor 1 will be described.

In some embodiments, the step S400 includes the following steps.

Firstly, the control current required by the pressure control valve 8 of the motor 1 is calculated according to the working pressure required by the motor 1. After a pressure electromagnetic valve is determined, there exists a definite functional relationship between the working pressure of the motor 1 and the current of the pressure control valve 8.

Secondly, the control current of the pressure control valve 8 is adjusted to be equal to the control current required by the pressure control valve 8.

Hereinafter, a specific embodiment is introduced.

Step 1: the controller 4, according to a voltage signal of the motor working gear knob 5, converts the voltage signal into a current or voltage signal and provides the current or voltage signal to the displacement control valve 6 of the motor 1 to adjust the working displacement of the motor 1 and calculate the displacement value $q_m$ of the current working gear position of the motor 1.

Step 2: according to the current working displacement value of the motor 1 and the maximum working pressure difference of the motor 1 allowed by a hydraulic system, the controller 4 calculates the maximum push-pull force output by the current gear position of the drilling machine through the formula (3):

$$F_{max} = \frac{\Delta P_{max} \cdot q_m \cdot i}{2\pi \cdot R}.$$

In the formula (3): $F_{max}$ is the maximum push-pull force output by a current gear position of the drilling machine; $\Delta P_{max}$ is a maximum working pressure difference of the motor 1 allowed by the hydraulic system; $q_m$ is a displacement of a current working gear position of the motor 1; i is a velocity ratio of the reducer 2; and R is a reference radius of the gear wheel 3.

Step 3: the controller 4 determines the push-pull force value $F_t$ required to be controlled according to the position signal of the push-pull force adjusting component 7, and compares it with the maximum push-pull force $F_{max}$ output by the current gear position of the drilling machine. If $F_t \geq F_{max}$, the displacement of the current working gear position of the motor 1 cannot implement the controlling of the constant value of the push-pull force, and the controller 4 needs to output a signal to change the input current or voltage of the displacement control valve 6 of the motor 1 and increase the working displacement $q_m$ of the motor 1 until $F_t < F_{max}$.

Step 4: according to the current working displacement value of the motor 1 and the push-pull force value $F_t$ required to be controlled, the controller 4 calculates the working pressure difference $\Delta P$ of the motor 1 required to be controlled through the formula (2):

$$\Delta P = \frac{2\pi \cdot R \cdot F_t}{q_m \cdot i}.$$

Step 5: the controller 4 compares the two pressures detected by the first pressure sensor 9 and the second pressure sensor 10 to determine the relatively small pressure value as the oil return back pressure.

Step 6: the controller 4 determines the sum of the working pressure difference of the motor 1 required to be controlled and the oil return back pressure as the working pressure of the motor 1 required to be controlled, converts it to the control current of the pressure control valve 8 according to the current and pressure characteristics of the pressure control valve 8, and outputs the control current to the pressure control valve 8.

Step 7: the controller 4 compares the oil return back pressures detected by the first pressure sensor 9 and the second pressure sensor 10 in real time with the oil return back pressure determined in the Step 5. If the oil return back pressure does not change, the control current of the pressure control valve 8 retains unchanged, and if the oil return back pressure changes, the Step 6 is returned to re-set the control current of the pressure control valve 8.

In the actual working process, according to the above technical solution, the push-pull force adjusting component 7 is employed to directly set the maximum push-pull force output by the horizontal directional drilling machine. The controller 4 controls the input current of the pressure control valve 8 in real time according to the position signal of the push-pull force adjusting component 7, the position signal of the motor working gear knob 5 and the oil return back pressure signal, so as to further control the maximum working pressure of the motor 1 in real time, thereby implementing the controlling of the constant value of the push-pull force. According to the actual construction situation, the push-pull force of the horizontal directional drilling machine only needs to be set once. After the working gear position of the motor 1 changes, there is no need to adjust it again. In this way, the control is accurate and fast to ensure the safety of the construction.

Figure 4:
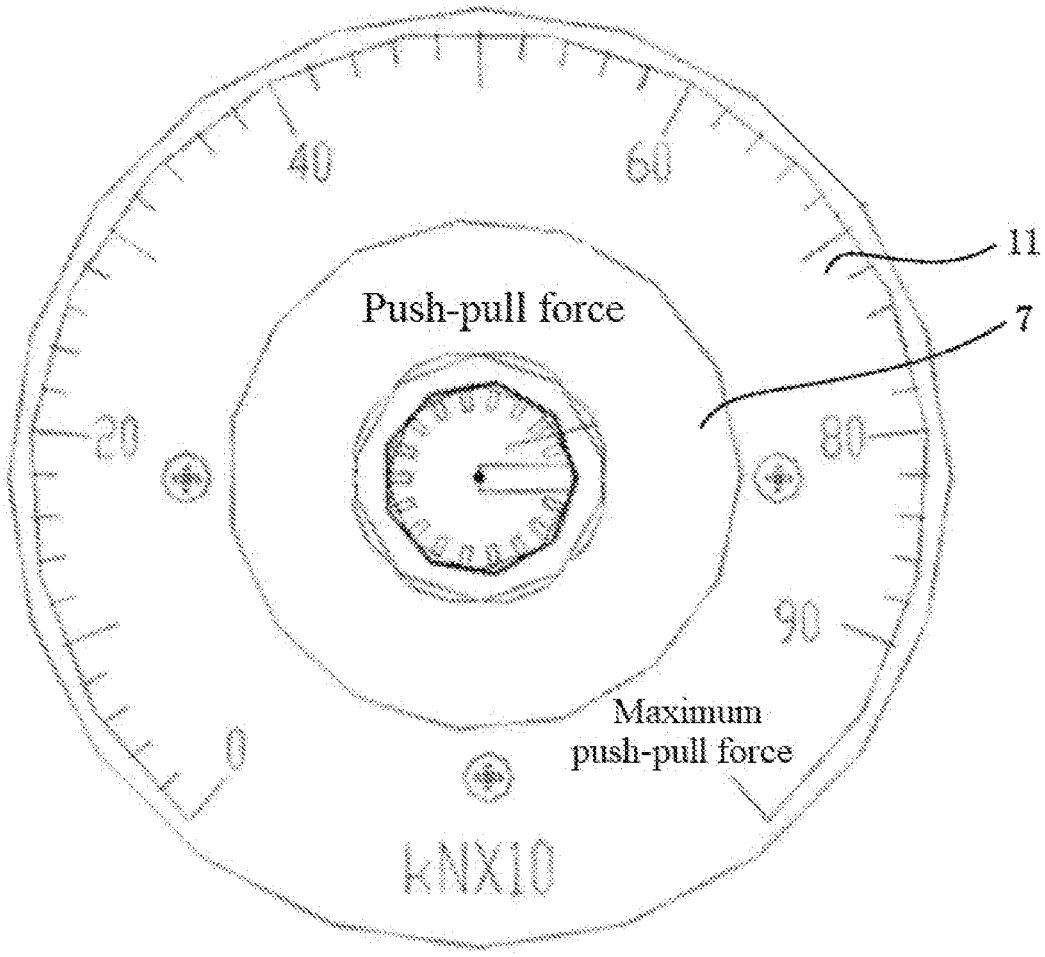
FIG. 4 is a schematic diagram of the structure of a push-pull force adjusting component of the horizontal directional drilling machine according to an embodiment of the present invention.

Referring to FIGS. 1 and 4, another embodiment of the present invention provides a horizontal directional drilling machine, which includes the motor 1, a motor displacement adjusting assembly, an oil return back pressure detecting assembly, the pressure control valve 8, a motor push-pull force setting assembly, and the controller 4. The motor displacement adjusting assembly is connected to the motor 1, and is configured to adjust a displacement of the motor 1. The oil return back pressure detecting assembly is connected to the motor 1, and is configured to detect an oil return back pressure of the motor 1. The pressure control valve 8 is connected to the motor 1, and is configured to control a working pressure of the motor 1. The motor push-pull force setting assembly is configured to set a push-pull force of the motor 1. The controller 4 is connected to the motor displacement adjusting assembly, the oil return back pressure detecting assembly, the pressure control valve 8 and the motor push-pull force setting assembly.

In some embodiments, the motor 1 includes a variable motor. The displacement control valve 6 is integrated on the motor 1, and the displacement of the motor 1 is controlled by the displacement control valve 6. The displacement control valve 6 is specifically, for example, an electromagnetic valve, and the displacement of the motor 1 is controlled by controlling the voltage or current of the electromagnetic valve.

In some embodiments, the motor displacement adjusting assembly includes the motor working gear knob 5 and the displacement control valve 6. The motor working gear knob 5 is connected to the controller 4. The displacement control valve 6 is connected to the controller 4 and the motor 1. The controller 4 is configured to control the current or voltage of the displacement control valve according to a gear position where the motor working gear knob 5 is located to control the displacement of the motor 1.

In some embodiments, the oil return back pressure detecting assembly includes the first pressure sensor 9 and the second pressure sensor 10. The first pressure sensor 9 is configured to detect a pressure of one of an oil inlet and an oil outlet of the motor 1. The second pressure sensor 10 is configured to detect a pressure of the other one of the oil inlet and the oil outlet of the motor 1. The first pressure sensor 9 and the second pressure sensor 10 transfer the detected pressure signals to the controller 4, respectively In some embodiments, the motor push-pull force setting assembly includes the push-pull force adjusting component 7 and the display component 11. The push-pull force adjusting component 7 is connected to the controller 4. The display component 11 is arranged at the periphery of the push-pull force adjusting component 7, and is configured to display a gear position where the push-pull force adjusting component 7 is located. It is convenient to obtain the set motor push-pull force value after the display component 11 is arranged.

In some embodiments, the push-pull force adjusting component 7 includes a potentiometer.

In the description of the present invention, it should be understood that orientations or positional relationships indicated by terms "center", "longitudinal", "transverse", "front", "rear", "left", "right", "vertical", "horizontal", "top", "bottom", "in/inside", "out/outside" and the like are orientations and positional relationships shown based on the drawings, merely in order to facilitate the description of the present invention and simplify the description, rather than indicating or implying that the device or element referred to must have a specific orientation or be configured or operated in a specific orientation, and thus cannot be understood as limitations on the content of protection of the present invention.

Finally, it should be noted that the above embodiments are merely used to illustrate the technical solutions of the present invention, not to limit them. Although the present invention is illustrated in detail by referring to the above embodiments, those having ordinary skill in the art should understand: the technical solutions recited by the respective embodiments described above still may be modified, or equivalent replacements may be made to the partial technical features thereof; but those modifications or replacements do not make the essence of the corresponding technical solution depart from the spirit and scope of the technical solution of each embodiment of the present invention.

What is claimed is:

1. A horizontal directional drilling machine, comprising:

a motor;

a motor displacement adjusting assembly, wherein the motor displacement adjusting assembly is connected to the motor, and the motor displacement adjusting assembly is configured to adjust a working displacement of the motor;

an oil return back pressure detecting assembly, wherein the oil return back pressure detecting assembly is connected to the motor, and the oil return back pressure detecting assembly is configured to detect an oil return back pressure of the motor;

a pressure control valve, wherein the pressure control valve is connected to the motor, and the pressure control valve is configured to control a working pressure of the motor by enabling an oil feeding pressure of the motor to be equal to the working pressure required by the motor;

a motor push-pull force setting assembly, wherein the motor push-pull force setting assembly is configured to set a push-pull force of the motor; and a controller, wherein the controller is connected to the motor displacement adjusting assembly, the oil return back pressure detecting assembly, the pressure control valve and the motor push-pull force setting assembly, and wherein the controller is configured to adjust the working displacement of the motor by controlling the motor displacement assembly, wherein a maximum push-pull force $F_{max}$ corresponding to the working displacement is greater than a set push-pull force $F_t$, and calculate a displacement value $q_m$ of the working displacement, calculate, based on the calculated displacement value $q_m$, a working pressure difference $\Delta P$ of the motor according to the set push-pull force $F_t$, calculate the working pressure required by the motor based on the calculated working pressure difference $\Delta P$ and on a first oil return back pressure of the motor after the first oil return back pressure of the motor is collected, adjust the pressure control valve of the motor based on the calculated working pressure required by the motor to enable the oil feeding pressure of the motor to be equal to the working pressure required by the motor.

2. A push-pull force control method for the horizontal directional drilling machine according to claim 1, comprising:

S100: adjusting the working displacement of the motor, wherein the maximum push-pull force $F_{max}$ corresponding to the working displacement is greater than a set push-pull force $F_t$ and calculating the displacement value $q_m$ of the working displacement;

S200: calculating, based on the calculated displacement value $q_m$, the working pressure difference $\Delta P$ of the motor according to the set push-pull force $F_t$;

S300: calculating the working pressure required by the motor based on the calculated working pressure difference $\Delta P$ and on the first oil return back pressure of the motor after the first oil return back pressure of the motor is collected; and S400: adjusting the pressure control valve of the motor based on the calculated working pressure required by the motor to enable the oil feeding pressure of the motor to be equal to the working pressure required by the motor.

3. The push-pull force control method of claim 2, wherein the step S100 comprises:

collecting a voltage signal corresponding to a current gear position of a motor working gear knob;

controlling a control voltage or a control current of a displacement control valve of the motor according to the voltage signal to control the working displacement of the motor;

calculating the maximum push-pull force $F_{max}$ corresponding to the calculated displacement value $q_m$ of the motor; and comparing the maximum push-pull force $F_{max}$ with the set push-pull force $F_t$, and when $F_t \geq F_{max}$, changing the control voltage or the control current of the displacement control valve of the motor to change the working displacement of the motor until $F_t < F_{max}$.

4. The push-pull force control method of claim 3, wherein the maximum push-pull force $F_{max}$ corresponding to the working displacement of the motor is calculated by the following formula:

$$F_{max} = \frac{\Delta P_{max} \cdot q_m \cdot i}{2\pi \cdot R},$$

wherein $F_{max}$ is the maximum push-pull force output by a current gear position of the horizontal directional drilling machine; $\Delta P_{max}$ is a maximum working pressure difference of the motor, wherein the maximum working pressure difference of the motor is allowed by a hydraulic system; $q_m$ is the displacement value of the working displacement of a current working gear position of the motor; i is a velocity ratio of a reducer connected to the motor; and R is a reference radius of a gear wheel connected to the reducer.

5. The push-pull force control method of claim 2, wherein in the step S200, the working pressure difference $\Delta P$ is calculated by the following formula:

$$\Delta P = \frac{2\pi \cdot R \cdot F_t}{q_m \cdot i},$$

wherein $q_m$ is the displacement value of the working displacement of a current working gear position of the motor; i is a velocity ratio of a reducer connected to the motor; and R is a reference radius of a gear wheel connected to the reducer.

6. The push-pull force control method of claim 2, wherein in the step S300, a pressure of an oil return port of the motor is collected as the first oil return back pressure.

7. The push-pull force control method of claim 2, wherein in the step S300, the first oil return back pressure of the motor is collected by the following steps:

collecting working pressures of two working oil ports of the motor to obtain collected working pressures of the two working oil ports of the motor; and comparing the collected working pressures of the two working oil ports of the motor, and using a smallest working pressure of the collected working pressures as the first oil return back pressure.

8. The push-pull force control method of claim 7, wherein the working pressures of the two working oil ports of the motor are collected using following steps:

using a first pressure sensor to detect a working pressure of a first working oil port of the two working oil ports of the motor; and using a second pressure sensor to detect a working pressure of a second working oil port of the two working oil ports of the motor.

9. The push-pull force control method of claim 2, further comprising:

S500: monitoring a second oil return back pressure of the motor in real time, and performing a comparison between the second oil return back pressure and the first oil return back pressure to determine whether the second oil return back pressure is equal to the first oil return back pressure after the second oil return back pressure of the motor is collected; and S600: when the second oil return back pressure is not equal to the first oil return back pressure, adjusting the oil feeding pressure of the motor to enable the second oil return back pressure of the motor to be equal to the first oil return back pressure.

10. The push-pull force control method of claim 2, wherein the step S400 comprises:

calculating a control current required by the pressure control valve of the motor according to the working pressure required by the motor; and adjusting a control current of the pressure control valve to be equal to the control current required by the pressure control valve.

11. The horizontal directional drilling machine of claim 1, wherein the motor comprises a variable motor.

12. The horizontal directional drilling machine of claim 1, wherein the motor displacement adjusting assembly comprises:

a motor working gear knob, wherein the motor working gear knob is connected to the controller; and a displacement control valve, wherein the displacement control valve is connected to the controller and the motor; wherein the controller is configured to control a current or a voltage of the displacement control valve according to a gear position of the motor working gear knob to control the working displacement of the motor.

13. The horizontal directional drilling machine of claim 1, wherein the oil return back pressure detecting assembly comprises:

a first pressure sensor, wherein the first pressure sensor is configured to detect a pressure of one of an oil inlet and an oil outlet of the motor; and a second pressure sensor, wherein the second pressure sensor is configured to detect a pressure of the other one of the oil inlet and the oil outlet of the motor.

14. The horizontal directional drilling machine of claim 1, wherein the motor push-pull force setting assembly comprises:

a push-pull force adjusting component, wherein the push-pull force adjusting component is connected to the controller; and a display component, wherein the display component is arranged at a periphery of the push-pull force adjusting component, and the display component is configured to display a gear position of the push-pull force adjusting component.

15. The horizontal directional drilling machine of claim 14, wherein the motor push-pull force setting assembly comprises a potentiometer.

* * * * *